US012292211B2

(12) United States Patent
Yang et al.

(10) Patent No.: US 12,292,211 B2
(45) Date of Patent: May 6, 2025

(54) SYSTEM AND METHOD TO CREATE INDOOR THERMAL ENVIRONMENT BASED ON IJV AND DPV

(71) Applicants: TIANJIN CHENGJIAN UNIVERSITY, Tianjin (CN); XI'AN UNIVERSITY OF ARCHITECTURE AND TECHNOLOGY, Xi'an (CN)

(72) Inventors: Bin Yang, Tianjin (CN); Pengju Liu, Tianjin (CN); Yihang Liu, Tianjin (CN); Bingan Pan, Tianjin (CN); Pengfei Yang, Tianjin (CN); Dacheng Jin, Tianjin (CN)

(73) Assignees: TIANJIAN CHENGJIAN UNIVERSITY, Tianjin (CN); XI'AN UNIVERISTY OF ARCHITECTURE AND TECHNOLOGY, Xi'An (CN)

( * ) Notice: Subject to any disclaimer, the term of this patent is extended or adjusted under 35 U.S.C. 154(b) by 388 days.

(21) Appl. No.: 17/844,684

(22) Filed: Jun. 20, 2022

(65) Prior Publication Data

US 2023/0213224 A1 Jul. 6, 2023

(30) Foreign Application Priority Data

Jan. 4, 2022 (CN) ..... 202210006327.4

(51) Int. Cl.
*F24F 7/007* (2006.01)
*F24F 13/06* (2006.01)

(52) U.S. Cl.
CPC ..... *F24F 7/007* (2013.01); *F24F 13/06* (2013.01); *F24F 2221/38* (2013.01)

(58) Field of Classification Search
CPC ..... F24F 7/007; F24F 13/06; F24F 2221/38; F24F 13/0604; F24F 2221/10; F24F 7/065; F24F 2007/001; A47B 2200/06
See application file for complete search history.

(56) References Cited

U.S. PATENT DOCUMENTS

2006/0079170 A1* 4/2006 Schmid ..... F24F 1/0073 454/187
2007/0131299 A1* 6/2007 Kornbleet ..... B32B 15/14 138/149
2013/0281000 A1* 10/2013 Newcomer ..... F24F 7/08 454/237

FOREIGN PATENT DOCUMENTS

CN 102705912 A * 10/2012
CN 106642494 A * 5/2017

OTHER PUBLICATIONS

English translation of CN-102705912-A, dated Sep. 5, 2024 (Year: 2024).*

(Continued)

*Primary Examiner* — Edelmira Bosques
*Assistant Examiner* — Brett Peterson Mallon
(74) *Attorney, Agent, or Firm* — Hemisphere Law, PLLC; Zhigang Ma

(57) ABSTRACT

A system and a method are provided to create an indoor thermal environment based on impinging jet ventilation (IJV) and ductless personalized ventilation (DPV), the system includes an IJV duct installed on a wall of a room and a DPV device installed on a table. An air inlet of the IJV duct is connected to an air conditioning system and an air outlet of the IJV duct is close to ground. An upper duct and a lower duct of the DPV device are disposed on two opposite sides of a tabletop, the upper duct is provided with an air supply panel, the lower duct is provided with a duct fan with an air supply volume being adjustable, and the duct fan is configured to send air absorbed from a ground air lake to a user's face area through the air supply panel of the upper duct.

14 Claims, 3 Drawing Sheets

(56) References Cited

OTHER PUBLICATIONS

English translation of CN-106642494-A, dated Sep. 5, 2024 (Year: 2024).*

* cited by examiner

SYSTEM AND METHOD TO CREATE INDOOR THERMAL ENVIRONMENT BASED ON IJV AND DPV

TECHNICAL FIELD

The disclosure relates to the technical field of heating, ventilation and air conditioning (HVAC), in particular to a system and a method to create an indoor thermal environment based on impinging jet ventilation (IJV) and ductless personalized ventilation (DPV).

BACKGROUND

People spend 90% of their time indoors, a HVAC system can produce good indoor thermal comfortable conditions and air quality for people in buildings, and the energy consumption of the HVAC system accounts for about 50% of the building energy consumption. A traditional ventilation mode is mainly mixed ventilation, as people pay more and more attention to global warming and energy saving, people have developed a new ventilation air distribution with energy-saving effects, such as displacement ventilation (DV) and IJV. The DV and the IJV only deal with the load in a work area, therefore it has a great energy-saving effect. The DV sends a low momentum air directly into a room through a diffuser, cold air forms an air lake on ground. When the cold air meets a heat source, it is heated and rises to form a thermal plume, resulting in a thermal stratification in the room. A temperature in the work area is lower than that in an upper part of the room, which has energy-saving effects while meeting a thermal comfort of a user. But the DV cannot used in winter, because a low momentum hot air has already floated upward due to the thermal buoyancy before it completely reaches the surrounding of the room, and the effects of the DV are very poor in winter. Therefore, some scholars have proposed the IJV, an air distribution form is that a high momentum wind sent by an air duct spreads around after hitting a floor to form a thin air lake, the high-speed air lake can well cover the whole room, this also overcomes a shortage that the DV cannot be used in winter. The IJV has a high air supply speed, therefore it is used in large space. When the IJV is used in an office, there are risks of a feet blowing sensation and head-to-feet temperature differences, which can result in a user's thermal discomfort in the office.

SUMMARY

In order to solve some problems in prior art, the disclosure provides a system and a method to create an indoor thermal environment based on IJV and DPV, which combines personalized ventilation and ductless to avoid a blowing feeling and head-to-feet temperature differences. At the same time, it can also meet the preferences of different users to solve some problems that may exist when the IJV is used in an office.

In order to achieve the above objective, the disclosure provides a technical scheme: a system to create an indoor thermal environment based on IJV and DPV, including an IJV duct and a DPV device, the IJV duct is installed on a wall of a room, an air inlet of the IJV duct is connected to an air supply duct of an air conditioning system, an air outlet of the IJV duct is close to ground, the DPV device is installed on a table, and the DPV device includes:

an upper duct and a lower duct, disposed on two opposite sides of a tabletop respectively;

an air supply panel, disposed on an outlet of the upper duct; and a duct fan, disposed in the lower duct, an air supply volume of the duct fan is adjustable, and the duct fan is configured to send air absorbed from a ground air lake to a user's face area through the air supply panel of the upper duct.

In an embodiment, the DPV device further includes: a flexible duct, connected the air supply panel with the outlet of the upper duct, and configured to adjust an air supply angle of the air supply panel.

In an embodiment, the air supply panel is a circular plate with a diameter in a range of 0.1 m to 0.15 m, and the air supply panel are evenly distributed with holes.

In an embodiment, a lowest end of the lower duct is provided with an air suction inlet, and the DPV device further includes: a filter layer, and the filter layer and the duct fan are provided in the lower duct from top to bottom in sequential order.

In an embodiment, an air volume of the duct fan is in a range of 80 $m^3/h$ to 120 $m^3/h$.

In an embodiment, the tabletop is provided with a switch, the switch is electrically connected to the duct fan and configured to control an air supply volume of the air supply panel.

In an embodiment, outer walls of the upper duct and the lower duct are respectively wrapped with heat preservation cotton.

In an embodiment, each of lengths of the upper duct and the low duct is adjustable, and a distance between a bottom end of the lower duct and a bottom surface is in a range of 0.1 m to 0.2 m.

In an embodiment, a length of the upper duct is 0.4 m, and a length of the lower duct is 0.6 m.

The disclosure further provides a method for using the system to create the indoor thermal environment based on IJV and DPV, including:

sending the air from the air supply duct of the air conditioning system out from the air outlet of the IJV duct, and the air diffusing on the ground after touching the ground;

adjusting the air supply volume of the duct fan disposed in the lower duct of the DPV device; and starting the duct fan to make the air near the ground enter the upper duct through the lower duct and to the user's face area.

Compared with the prior art, the disclosure has at least the following beneficial effects:

the disclosure provides the system to create the indoor thermal environment based on IJV and DPV, which combines the IJV with the DPV. The system sucks the cold air directly from an air lake, which reduces unnecessary air supply ducts, reduces head-to-feet temperature differences and a blowing sensation while using IJV alone, meets human thermal comfort requirements, and improves a background setting temperature of the room, i.e., the temperature of the IJV system, reduces the energy consumption of the air conditioner, and has the potential of energy saving.

In the disclosure, the air supply volume of the duct fan is adjustable, and the user can freely adjust the air supply volume of the duct fan according to their own needs, which can greatly improve the thermal comfort of human body.

In the disclosure, the DPV duct is provided with the filter layer. The filter layer can filter air near the ground and send the clean air to a breathing area of the user, which improves the quality of inhaled air of the user.

DESCRIPTION OF REFERENCE NUMERALS

1—IJV duct, 2—air supply panel, 3—flexible duct, 4—upper duct, 5—heat preservation cotton, 6—lower duct, 7—filter layer, 8—duct fan, 9—air suction inlet, 10—switch, 11—tabletop.

DETAILED DESCRIPTION OF EMBODIMENTS

The disclosure is further described in detail below in combination with the attached drawings and embodiments.

As shown in FIG. 1 to FIG. 7, the disclosure provides a system to create an indoor thermal environment based on IJV and DPV. A personalized ventilation means that clean cold air is directly sent to a breathing area of a user, the user can freely adjust the local micro-environment according to his own thermal comfort, the personalized ventilation is often used in combination with the background air conditioner to save energy. The DPV means that an air duct is not connected to a system unit, but extends the air duct into an air lake under a background of the displacement ventilation (DV), and sucks the clean cold air from the air lake and sends the clean cold air to the breathing area of the user.

The system of the disclosure includes an IJV duct 1 and a DPV device, the DPV device is fixed on a table, the IJV duct 1 is installed on a wall of a room, common installation methods of the IJV duct include the IJV duct being installed on a center of a wall or a corner of a wall, an upper air inlet of the IJV duct 1 is connected to an air supply duct of an air conditioning, a lower part of the IJV duct is an air outlet, a diameter of the IJV duct 1 is 0.25 m, and a distance between the air outlet and ground is in a range of 0.3 m to 1 m, in an embodiment, the distance is 0.4 m.

Figure 3:
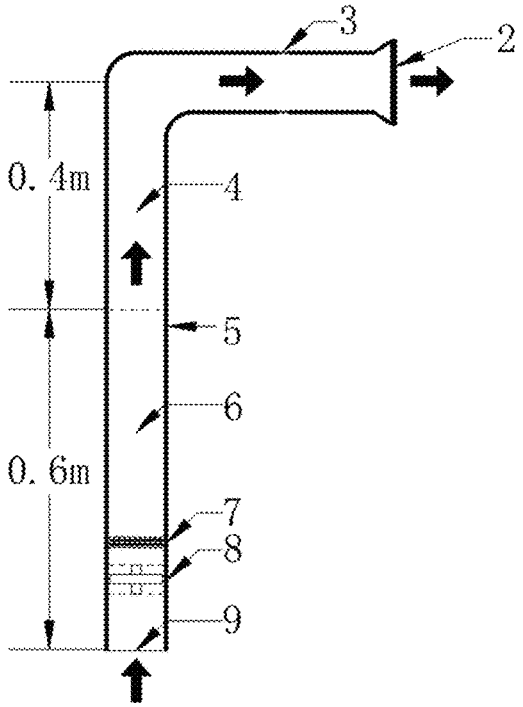
FIG. 3 illustrates a detailed schematic diagram of ducts in the DPV device.

The DPV device includes an air supply panel 2, a flexible duct 3, an upper duct 4, heat preservation cotton 5, a lower duct 6, a filter layer 7, a duct fan 8 and an air suction inlet 9, there is a mounting hole on a tabletop 11, the mounting hole is disposed on the table far away from a seat for a user, some details of the DPV device are shown in FIG. 3, the upper duct 4 and the lower duct 6 are disposed on two opposite sides of the tabletop 11 respectively, a lowest end of the lower duct 6 is provided with the air suction inlet 9, the filter layer 7 and the duct fan 8 are provided in the lower duct 6 from top to bottom in sequential order, the air outlet of the lower duct 6 is connected to an air inlet of the upper duct 4, an outlet of the upper duct 4 is connected to the flexible duct 3 and the flexible duct 3 is facing with the seat of the user, an outlet of the flexible duct 3 is connected to the air supply panel 2, the flexible duct 3 is configured to adjust a direction of the air supply panel 2, the user can adjust the air supply panel 2 to a suitable direction through the flexible duct 3, and the upper duct 4 and the lower duct 6 are respectively wrapped with the heat preservation cotton 5 with a thickness of 0.0055 m, thereby to prevent cold air in a duct from being heated.

Figure 1:
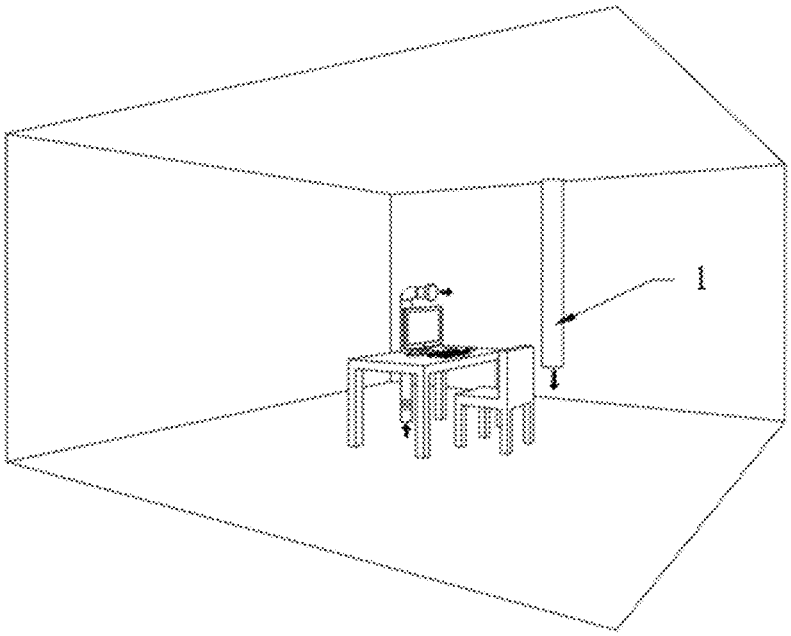
FIG. 1 illustrates a global schematic diagram of a system.
Figure 2:
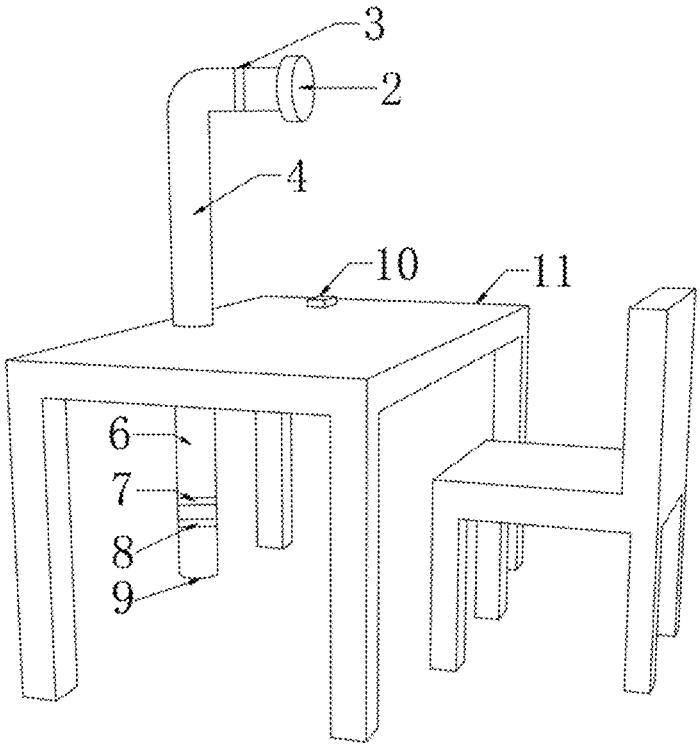
FIG. 2 illustrates a schematic diagram of a DPV device.

In an illustrated embodiment, as shown in FIG. 2, a length of the upper duct 4 is adjustable, a distance from the tabletop 11 to a center line of the air supply panel 2 is 0.4 m. The upper duct 4 is above the tabletop 11, and an inner diameter of the upper duct 4 is 0.1 m.

In an illustrated embodiment, a length of the lower duct 6 can be adjusted with a height of the tabletop 11, which is to keep a distance between a bottom of the lower duct 6 and ground be in a range of 0.1 m to 0.2 m. The disclosure is designed based on a height of a regular table, and in an embodiment, the length of the lower duct 6 here can be 0.6 m.

In an illustrated embodiment, the filter layer 7 includes activated carbon, which is configured to absorb odors of air passing through the duct.

Figure 5:
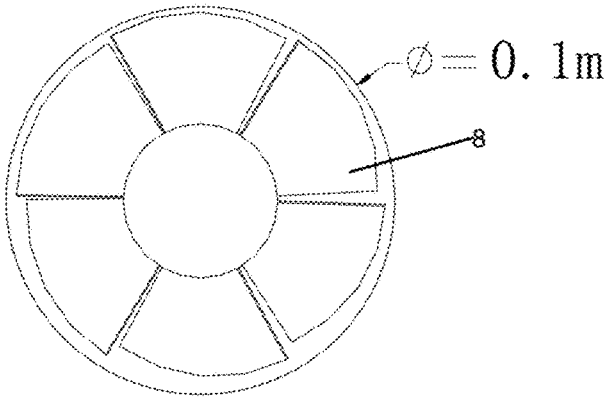
FIG. 5 illustrates a schematic diagram of a duct fan.

In an illustrated embodiment, as shown in FIG. 5, the duct fan 8 sucks cold air from an air lake through the air suction inlet 9 of the lower duct 6. An outer diameter of the duct fan 8 is 0.1 m, while its air volume is in a range of 80 $m^3/h$ to 120 $m^3/h$, power is 25 W, and voltage is 220 V.

In an illustrated embodiment, the tabletop 11 is provided with a switch 10, the switch 10 is electrically connected to the duct fan 8 to adjust an air suction volume of the duct fan 8, and thereby adjust an air supply volume of the air supply panel 2. The switch 10 has three gears. The Air volume of gear I is 5 L/s, the air volume of gear II is 10 L/s, and the air volume of gear III is 15 L/s.

Figure 4:
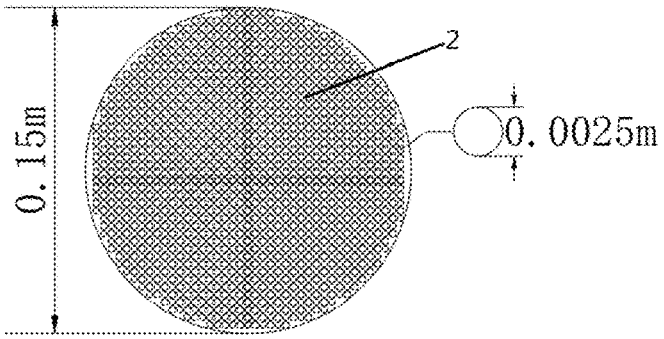
FIG. 4 illustrates a schematic diagram of an air supply panel.

In an illustrated embodiment, as shown in FIG. 4, the air supply panel is a circular plate with a diameter in a range of 0.1 m to 0.15 m, and the air supply panel are evenly distributed with holes, a diameter of each of the holes may be 0.0025 m, and a distance between two centers of two adjacent holes is 0.0289 m. A size of the air supply panel 2 is a common size for personalized ventilation. The holes are provided to enable air to be evenly sent to a breathing area of the user and reduce generation of blowing feeling.

The DPV device can also be used in winter. However, a difference from summer, a temperature distribution of a stratified air conditioner is hot at a bottom and cold at a top. In order to ensure the work efficiency of a user, the heat demand of the user is usually hot at a bottom and slightly cool at a head. Therefore, an effect of using the device in summer is more obvious.

In an illustrated embodiment, in a typical office which length×width×height is 5 m×3 m×3 m. Setting parameters of an IJV air conditioner are set that an air supply temperature is 22° C. and an air supply speed is 1.5 m/s. An air supply parameter for specific applications can be determined according to indoor load. A typical table is connected to the DPV device, the typical table has a size which length×width×height is 1.2 m×0.6 m×0.75 m. Some arrows in FIG. 3 reflect a flow direction of air in a duct.

Figure 6:
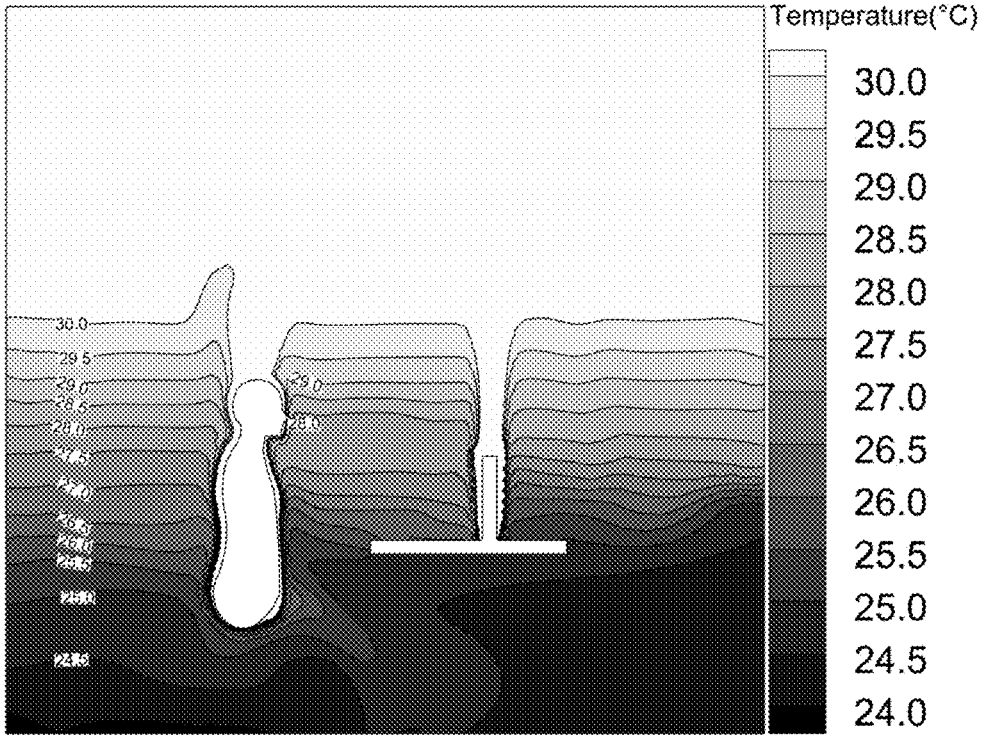
FIG. 6 illustrates a schematic diagram of a temperature distribution around a user when using IJV.

FIG. 6 shows a temperature distribution around a user when IJV is used alone (the air supply temperature is 22° C. and the air supply speed is 1.5 m/s). It can be seen that a temperature difference between a head and feet of the user is about 5° C., a head temperature of the user is 29° C., and the head is in an overheated state.

Figure 7:
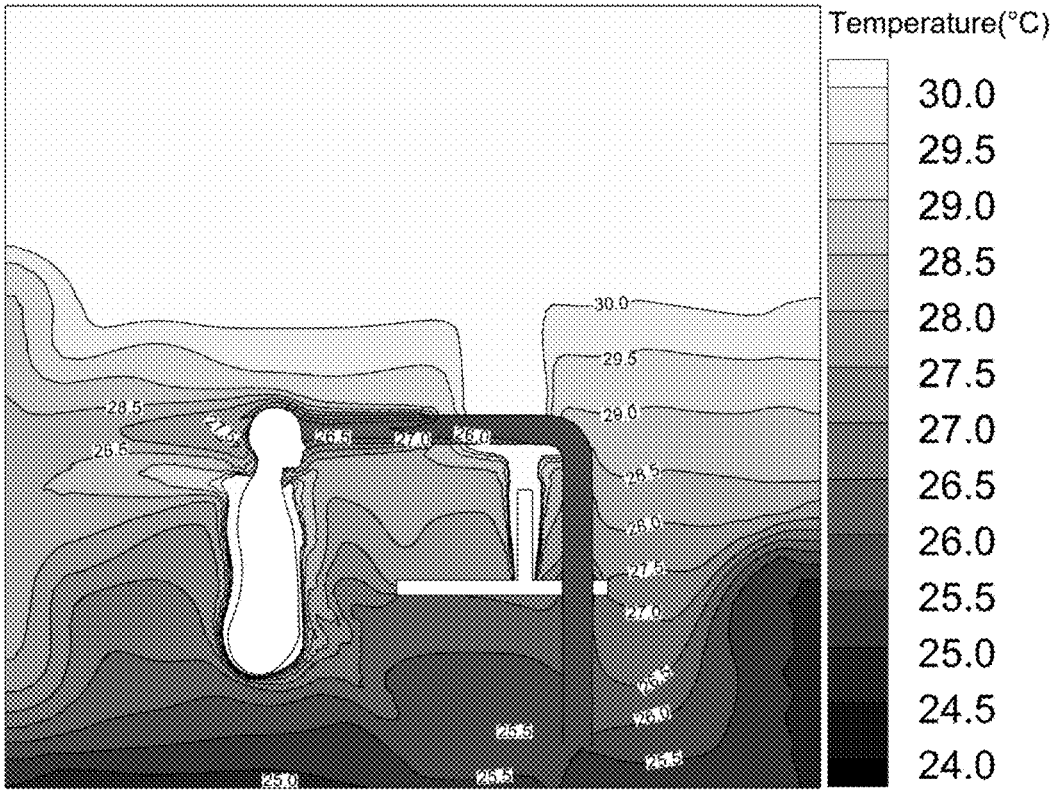
FIG. 7 illustrates a schematic diagram of a temperature distribution around a user when using IJV and DPV.

FIG. 7 shows a temperature distribution around a user when IJV and DPV are used in a method. It can be seen that a temperature difference between a head and feet of the user is 1.5° C., the method significantly reduces the temperature difference between the head and feet of the user, a temperature in a breathing area of the user is 26.5° C., and the temperature is an appropriate work temperature.

The disclosure provides a method for using the system to create an indoor thermal environment based on IJV and DPV, including:

1. turning on an IJV background air conditioner in a typical manned office, sending cold air from the air outlet of the IJV duct 1, and the cold air diffusing on the ground after touching the ground;
2. a user who at a station can adjust the air suction volume of the duct fan 8 to a required gear by adjusting the switch 10 according to his own thermal state;
3. starting the duct fan 8, and the cold air near the ground is sucked into the lower duct 6 of the DPV device through the air suction inlet 9;
4. when the cold air passes through the filter layer 7, odors of the air are adsorbed by activated carbon in the filter layer, and the pollutants are also removed by the filter layer, thereby obtaining cleaner cold air; and
5. the clean cold air enters the upper duct 4 and is sent to the user's breathing area through the holes of the air supply panel 2. At the same time, the user can adjust the air supply direction of the air supply panel 2 to a suitable direction through the flexible duct 3 according to their own needs. The cold air sent to the user's breathing area can reduce a head temperature of the user and improve his thermal comfort.

What is claimed is:

1. A system to create an indoor thermal environment based on ductless personalized ventilation (DPV) and impinging jet ventilation (IJV), comprising: an IJV duct and a DPV device; wherein the IJV duct is installed on a wall of a room, an air inlet of the IJV duct is connected to an air supply duct of an air conditioning system, an air outlet of the IJV duct is located inside the room and close to ground in the room, the DPV device is installed on a table, and the DPV device comprises:

an upper duct and a lower duct, disposed on two opposite sides of a tabletop respectively;

an air supply panel, disposed on an outlet of the upper duct;

a duct fan, disposed in the lower duct and closer to the ground in the room relative to the upper duct, wherein an air supply volume of the duct fan is adjustable, and the duct fan is configured to send air absorbed from a ground air lake to a user's face area through the air supply panel of the upper duct;

a flexible duct, directly connected between the air supply panel and the outlet of the upper duct, wherein the flexible duct is adjustable relative to the upper duct and configured to adjust an air supply angle of the air supply panel; and a filter layer, disposed in the lower duct and located at a side of the duct fan facing away from the ground, wherein the filter layer comprises activated carbon, which is configured to absorb odors of the air sent from the duct fan.

2. The system to create the indoor thermal environment based on IJV and DPV according to claim 1, wherein the air supply panel is a circular plate with a diameter in a range of 0.1 m to 0.15 m, and the air supply panel are evenly distributed with holes.

3. The system to create the indoor thermal environment based on IJV and DPV according to claim 2, wherein each hole of the air supply panel is an circular hole with a diameter of 0.0025 m, and a distance between two centers of adjacent two of the holes is 0.0289 m.

4. The system to create the indoor thermal environment based on IJV and DPV according to claim 1, wherein a lowest end of the lower duct is provided with an air suction inlet, and the filter layer, the duct fan, and the air suction inlet are provided in the lower duct from top to bottom in sequential order.

5. The system to create the indoor thermal environment based on IJV and DPV according to claim 4, wherein the tabletop is provided with a switch, the switch is electrically connected to the duct fan and configured to control an air supply volume of the air supply panel.

6. The system to create the indoor thermal environment based on IJV and DPV according to claim 5, wherein the switch has first to third gears, an air volume of the first gear is 5 L/s, an air volume of the second gear is 10 L/s, and an air volume of the third gear is 15 L/s.

7. The system to create the indoor thermal environment based on IJV and DPV according to claim 4, wherein the air suction inlet at the lowest end of the lower duct is closer to the ground in the room than the air outlet of the IJV duct.

8. The system to create the indoor thermal environment based on IJV and DPV according to claim 7, wherein a distance between the air outlet of IJV duct and the ground in the room is in a range of 0.3 m to 1 m, and a distance between the air suction inlet at the lowest end of the lower duct and the ground in the room is in a range of 0.1 m to 0.2 m.

9. The system to create the indoor thermal environment based on IJV and DPV according to claim 1, wherein an air volume of the duct fan is in a range of 80 $m^3$/h to 120 $m^3$/h.

10. The system to create the indoor thermal environment based on IJV and DPV according to claim 1, wherein outer walls of the upper duct and the lower duct are wrapped with heat preservation cotton respectively.

11. The system to create the indoor thermal environment based on IJV and DPV according to claim 1, wherein each of lengths of the upper duct and the lower duct is adjustable, and a distance between a bottom end of the lower duct and a bottom surface is in a range of 0.1 m to 0.2 m.

12. The system to create the indoor thermal environment based on IJV and DPV according to claim 1, wherein a length of the upper duct is 0.4 m, and a length of the lower duct is 0.6 m.

13. A method for using the system to create the indoor thermal environment based on IJV and DPV according to claim 1, comprising:

sending the air from the air supply duct of the air conditioning system out from the air outlet of the IJV duct, and the air diffusing on the ground in the room after touching the ground;

adjusting the air supply volume of the duct fan disposed in the lower duct of the DPV device; and starting the duct fan to make the air near the ground be filtered by the filter layer and enter the upper duct through the lower duct and to the user's face area, and adjusting the flexible duct to change an air supply angle of the air supply panel to the user's face area.

14. A system to create an indoor thermal environment based on ductless personalized ventilation (DPV) and impinging jet ventilation (UV), comprising:

an IJV duct, installed on a wall of a room, wherein two ends of the IJV duct are respectively provided an air inlet and an air outlet, the air inlet of the IJV duct is connected to an air supply duct of an air conditioning system, and the air outlet of the IJV duct is located in the room and close to ground in the room;

a DPV device, installed on a table in the room, and the DPV device comprises:

an upper duct, located at an upper side of the table and disposed on a tabletop, and provided with an air inlet and an outlet;

a flexible duct, located at the upper side of the table and directly connected to the outlet of the upper duct;

an air supply panel, located at the upper side of the table and directly connected to an end of the flexible duct facing away from the outlet of the upper duct;

a lower duct, located at a lower side of the table, wherein two ends of the lower duct are respectively provided with an air suction inlet and an air outlet, the air suction inlet of the lower duct is facing towards the ground in the room and spaced from the ground in the room, and the air outlet of the lower duct is directly connected to the air inlet of the upper duct;

a filter layer, located at the lower side of the table, wherein the filter layer is disposed in the lower duct and between the air suction inlet of the lower duct and the air outlet of the lower duct; and a duct fan, located at the lower side of the table and in the lower duct, wherein the duct fan is located at a side of the filter layer close to the air suction inlet of the lower duct; and a switch, disposed on the tabletop and electrically connected to the duct fan;

wherein the IJV duct is configured to send air from the air supply duct of the air conditioning system to the ground in the room, thereby to make the air diffuse on the ground after touching the ground to form a ground air lake; the duct fan is configured to absorb the air from the ground air lake to the filter layer, thereby to make the filter layer filter the air and send filtered air to a user's face area through the lower duct, the upper duct, the flexible duct and the air supply panel in sequence.

* * * * *